US005465916A

United States Patent [19]

König

[11] Patent Number: 5,465,916

[45] Date of Patent: Nov. 14, 1995

[54] WINDING UP AT LEAST ONE SYNTHETIC-RESIN YARN

[75] Inventor: Günter König, Uhingen-Baiereck, Germany

[73] Assignee: Zinser Textilmaschinen GmbH, Ebersbach/Fils, Germany

[21] Appl. No.: 128,846

[22] Filed: Sep. 29, 1993

[30] Foreign Application Priority Data

Oct. 6, 1992 [DE] Germany ..... 42 33 638.4

[51] Int. Cl.[6] ..... B65H 54/00; B65H 75/28

[52] U.S. Cl. ..... 242/18 PW; 242/18 DD; 242/125.1

[58] Field of Search ..... 242/18 PW, 18 DD, 242/18 G, 125.1

[56] References Cited

U.S. PATENT DOCUMENTS

| | | | |
|---|---|---|---|
| 2,898,054 | 8/1959 | Rea | 242/125.1 |
| 3,198,445 | 8/1965 | Hull et al. | 242/18 |
| 4,058,264 | 11/1977 | Kawashima et al. | 242/18 PW |
| 4,138,071 | 2/1979 | Schewe | 242/18 PW |
| 4,561,600 | 12/1985 | Greive et al. | 242/18 PW |
| 5,263,656 | 11/1993 | Raasch | 242/18 PW |

FOREIGN PATENT DOCUMENTS

| | | | |
|---|---|---|---|
| 0477787A1 | 4/1992 | European Pat. Off. . | |
| 2432166 | 1/1976 | Germany . | |
| 2943392 | 5/1980 | Germany | 242/18 PW |
| 3009714 | 9/1980 | Germany . | |
| 265132 | 2/1989 | Germany . | |
| 95073 | 6/1983 | Japan | 242/18 PW |
| 4-4182274 | 6/1992 | Japan | 242/18 PW |
| 168689 | 4/1934 | Switzerland . | |
| 1175965 | 1/1970 | United Kingdom | 242/18 PW |

*Primary Examiner*—Daniel P. Stodola
*Assistant Examiner*—William Stryjewski
*Attorney, Agent, or Firm*—Herbert Dubno; Andrew Wilford

[57] ABSTRACT

An apparatus for winding a synthetic-resin yarn on a spool of predetermined outside diameter has a friction drive roller rotatable about a drive axis and having a substantially cylindrical outer surface of predetermined length centered on the drive axis. A drive can rotate this roller about the drive axis at a substantially constant speed. A support adjacent the friction roller holds the spool for rotation about a spool axis generally parallel to the drive axis and with the spool in radial contact with the surface of the drive roller. A radially outwardly projecting ridge carried on the support axially offset from the surface of the friction roller is of greater outside diameter than the spool. Guides feed the yarn initially to the ridge for winding of the yarn thereon and thereafter for feeding the yarn to the spool for winding of the yarn on the spool.

15 Claims, 5 Drawing Sheets

WINDING UP AT LEAST ONE SYNTHETIC-RESIN YARN

FIELD OF THE INVENTION

The present invention relates to the winding up of at least one synthetic-resin yarn. More particularly this invention concerns a winding method and apparatus used to wind the yarn on a spool before stretching the yarn.

BACKGROUND OF THE INVENTION

A standard yarn-winding apparatus has a support that holds a spool centered on a spool axis for rotation about this axis, a friction-drive roller that is rotated at a constant speed and that radially engages the spool to rotate it, and guides for feeding the yarn to the spool so it is wound thereon as the spool rotates. The guides includes a reciprocating traverse that lays the yarn in even layers on the rotating spool.

Synthetic-resin yarns are very sensitive to their treatment parameters, as for instance their temperature, amount of stretch, tension, and the like. Such a synthetic-resin yarn can take dye differently, develop different surface characteristics, and otherwise alter significantly to affect the appearance and feel of the finished goods, whether woven or knitted, that they are incorporated in if any of these treatment parameters varies excessively.

It has been determined that the yarn must be pulled at the very start of a winding operation with a tension that is somewhat greater than that used for the balance of the winding up. This increased tension, which must not be great enough to snap the yarn, pulls the yarn tight and causes it to move smoothly afterward.

It is therefore known from German patent document 2,432,166 of J. Bock et al to provide the friction-drive roller with an annular raised region of greater diameter than the body of the roller that is positioned offset axially from the region where the yarn body will be formed. Thus to start with the spool will be driven slightly faster than normal. Once, however, the yarn body has built up on the spool sufficiently that it directly contacts the friction roller, the spool-rotation speed is reduced again and depends on the peripheral velocity of the body of the friction roller, not of its raised rim. Such a system is very simple, but the first 1000 m or so of yarn is wound at a tension that is different from that of the balance of the yarn and, therefore, will behave differently in subsequent treatment.

In U.S. Pat. No. 3,831,362 of C. J. Dudzik the spool is provided at one end with a large-diameter rim, or such a rim is provided on the support carrying the spool. The friction-drive roller is cylindrical so that at the start of winding it contacts only this large-diameter rim so that the peripheral speed of the spool is smaller than that of the friction roller. This peripheral speed increases as the yarn body grows until the yarn body gets bigger than the rim and the drive roller loses contact with the rim, whereupon the peripheral speed stays the same for the rest of the winding operation. Thus the innermost layers of yarn are wound somewhat more loosely than the outer ones, again producing nonuniform results during subsequent treatment.

In German patent document 3,009,714 of Y. Inouye and British patent 1,175,965 other winding systems are shown, but that do not give a high starting speed to get the filament up to speed while at the same time winding it on the spool with uniform tension.

OBJECTS OF THE INVENTION

It is therefore an object of the present invention to provide an improved apparatus for winding up a yarn.

Another object is the provision of such an improved apparatus for winding up a yarn which overcomes the above-given disadvantages, that is which provides a high starting speed so that the filament is properly tensioned at the very start, but that subsequently winds the filament up at a constant running speed so that its tension in the wound-up yarn body is perfectly uniform.

Yet another object is to provide an improved method of winding a yarn up on a spool.

SUMMARY OF THE INVENTION

An apparatus for winding a synthetic-resin yarn on a spool of predetermined outside diameter has according to the invention a friction drive roller rotatable about a drive axis and having a substantially cylindrical outer surface of predetermined length centered on the drive axis. A drive can rotate the drive roller about the drive axis at a substantially constant speed. A support adjacent the friction roller holds the spool for rotation about a spool axis generally parallel to the drive axis and with the spool in radial contact with the surface of the drive roller. A radially outwardly projecting ridge carried on the support axially offset from the surface of the friction roller is of greater outside diameter than the spool. Guides feed the yarn initially to the ridge for winding of the yarn thereon and thereafter feed the yarn to the spool for winding of the yarn on the spool.

Thus to start with the yarn is caught on the ridge, then the friction drive roller is started rotating or, if it is already rotating, is brought into contact with the spool to rotate it and the ridge about the axis. Since the ridge is of greater diameter than the spool the yarn, so long as it is being wound on the ridge, will be advanced at a speed greater than the peripheral speed of the feed roller. Subsequently then the guide moves the yarn to the smaller-diameter body region of roller so the running speed of the yarn will slow down to be equal to the peripheral speed of the friction roller, and will remain at this speed for the balance of the winding operation. As a result the entire yarn package will be produced at the same speed and all the yarn will be identically tensioned.

According to the invention the diameter of the ridge is between 1% and 10%, preferably between 1% and 3%, larger than the diameter of the spool. This ridge can be mounted on the spool or can be part of the support. It must rotate jointly with the spool, since the friction drive roller engages the spool but never engages the ridge.

The ridge is provided with a yarn-retaining formation, typically in the form of a V-shaped notch in which the yarn is wedged.

The guides of this invention include a movable guide axially generally level with the ridge. Thus to start with the yarn passes over this guide until the yarn is up to speed, then the guide is retracted so the yarn snaps back into the normally provided axially reciprocating traverse that lays it in layers on the spool.

Furthermore according to the invention the spool is subdivided into a long main region adapted to receive a relatively large yarn body and a short end region offset from the main region and adapted to receive transfer loops of the yarn. The guides feed the yarn to the short end region to wind several such transfer loops of the yarn on the end region after winding it on the ridge and before winding it on the main region. This creates a small transfer region or zone so that the trailing end of the yarn can easily be located for attachment to the leading end of the yarn on another spool for a continuous operation. In this case the guides include an outer movable guide generally axially level with the ridge and an inner movable guide generally axially level with the short end region.

The guides can include a hook axially fixed adjacent the ridge and a movable element for trapping the yarn in the hook during winding on the ridge.

Thus the method of this invention comprises the steps of supporting the spool for rotation about the spool axis and supporting for rotation about a drive axis generally parallel to the spool axis a friction drive roller with a substantially cylindrical outer surface of a predetermined length centered on the drive axis and a radially outwardly projecting ridge axially offset from the roller surface and of greater outside diameter than the spool outer surface. The yarn is caught on the ridge and then the rotating friction roller is engaged radially with the spool and rotated to rotate the spool about the spool axis at a peripheral speed equal to a peripheral speed of the surface of the friction roller so that an outer surface of the ridge moves at a peripheral speed greater than that of the spool outer surface. Initially the yarn is fed to the ridge and thereby initially wound on the ridge, and thereafter the yarn is fed to the spool to wind the yarn thereon and form a yarn package on the spool.

In accordance with the invention two or more such spools are supported for rotation about the spool axis and are radially engaged by the friction roller for joint coaxial rotation and two such yarns are caught on the ridge and initially wound thereon. The yarns thereafter are fed to respective ones of the spools for forming respective yarn bodies thereon, but to start with are both wound on the ridge to get them up to speed.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
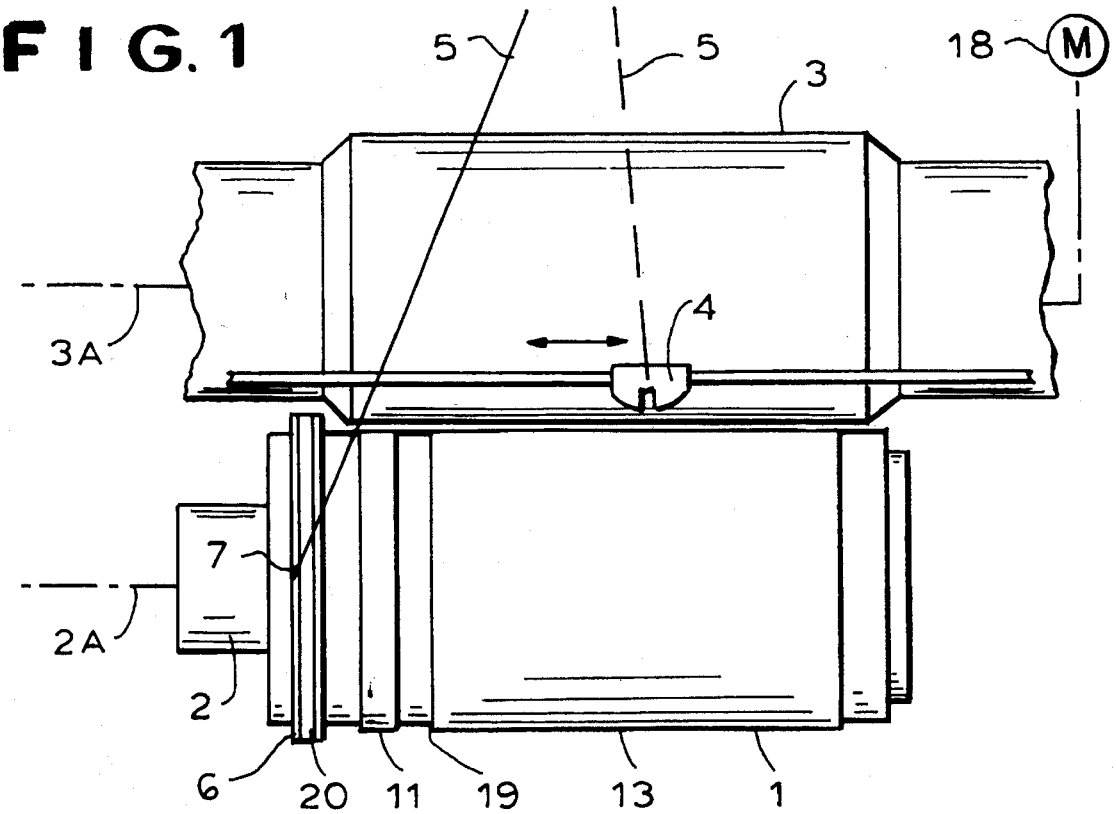
FIG. 1 is a partly diagrammatic view of the system of this invention.

As seen in FIGS. 1, 2A, 2B, and 2C, a cylindrically tubular spool 1 with a cylindrical outer surface subdivided into a long main region 13 and a short end region 11 separated by a groove 19 is carried on a support 2 rotatable about an axis 2A. Immediately adjacent this support 2 is a cylindrical friction-drive roller 3 rotatable by a motor 18 about an axis 3A parallel to the axis 2A. The roller 3 radially engages the regions 11 and 13 of the spool 1.

The support 2 carries at the end of the spool 1, past the end of the roller 3, a ring 6 forming a radially outwardly projecting ridge having an outer surface 20 of a diameter between 1% and 10%, preferably between 1% and 3%, greater than that of the spool 1 at the cylindrical regions 11 and 13. The ridge-forming ring 8 can be mounted on the spool 1 or part of the support 2.

A yarn 5 is, to start with, caught in a holding slit 7 or the like on the ring 6. Furthermore to start with this yarn 5 passes over a movable outer guide 9 of a guide device 8. This guide 9 is level with the surface 20 while another movable guide 12 of the device 8 is level with the region 11. A fixed axially extending guide 10 projects from the guide device 8 back along the entire length of the spool 1 to a standard traverse feed 4.

As the motor 18 rotates the roller 3 with the yarn end caught in the clip 7 and the yarn 5 passing over the outer guide 9, the yarn 5 will be wound on the surface 20 of the ring 6. This is the position of FIG. 2A. Since the ring 6 is of greater outside diameter than the regions 11 and 13, it will move at a greater peripheral speed, quickly getting the yarn 5 up to speed and taking any slackness out of it.

Subsequently the guide 9 is retracted so that the yarn 5 slips back and starts to wind around the end region 11 which moves more slowly, at the same peripheral speed as the roller 3. This is the FIG. 2B position. After a brief time the inner guide 12 is also retracted and the filament 5 slides along the guide 10 to catch on the standard reciprocating traverse 4 that lays it in successive layers on the region 13 in the manner well known in the art. This is the FIG. 2C position in which the yarn will continue to move at the same peripheral speed as the roller 3, even as the diameter of the yarn package increases.

When the winding operation is complete the spool 1 is pulled off the holder 2, breaking the yarn 5 between the region 11 and the surface 20 of the ring 6. The yarn 5 is easily picked up where it runs across the groove 19 between the regions 11 and 13 to allow attachment of this end of the yarn to the leading end of a succeeding package in a continuous operation.

Figure 3:
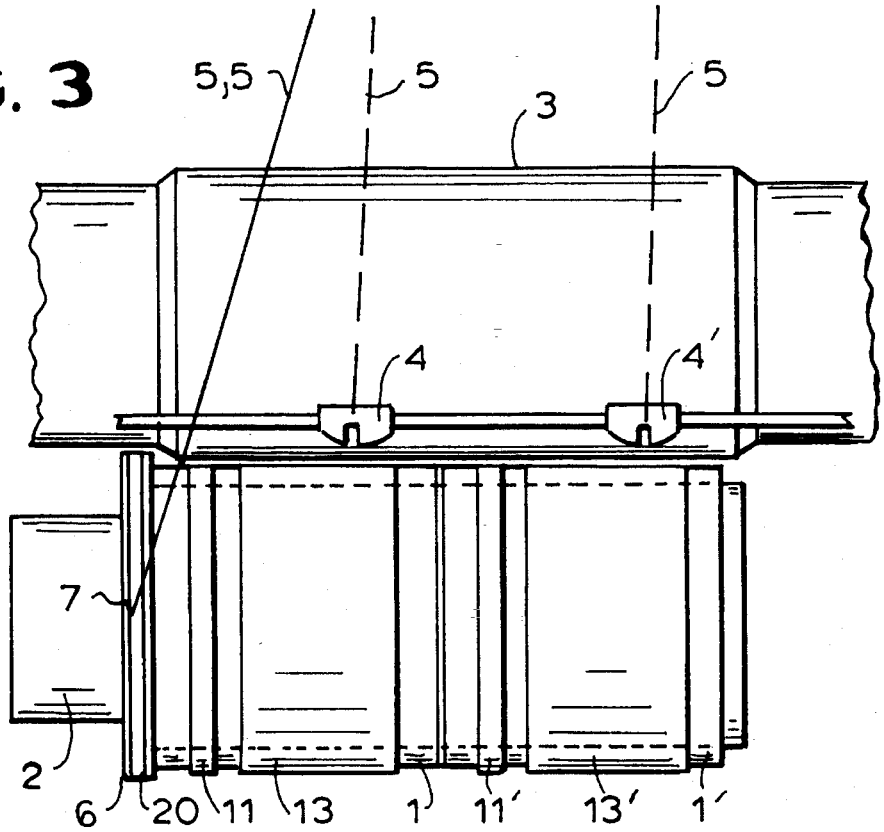
FIG. 3 is a view like FIG. 1 of another system of the present invention.
Figures 2A, 2B, 2C:
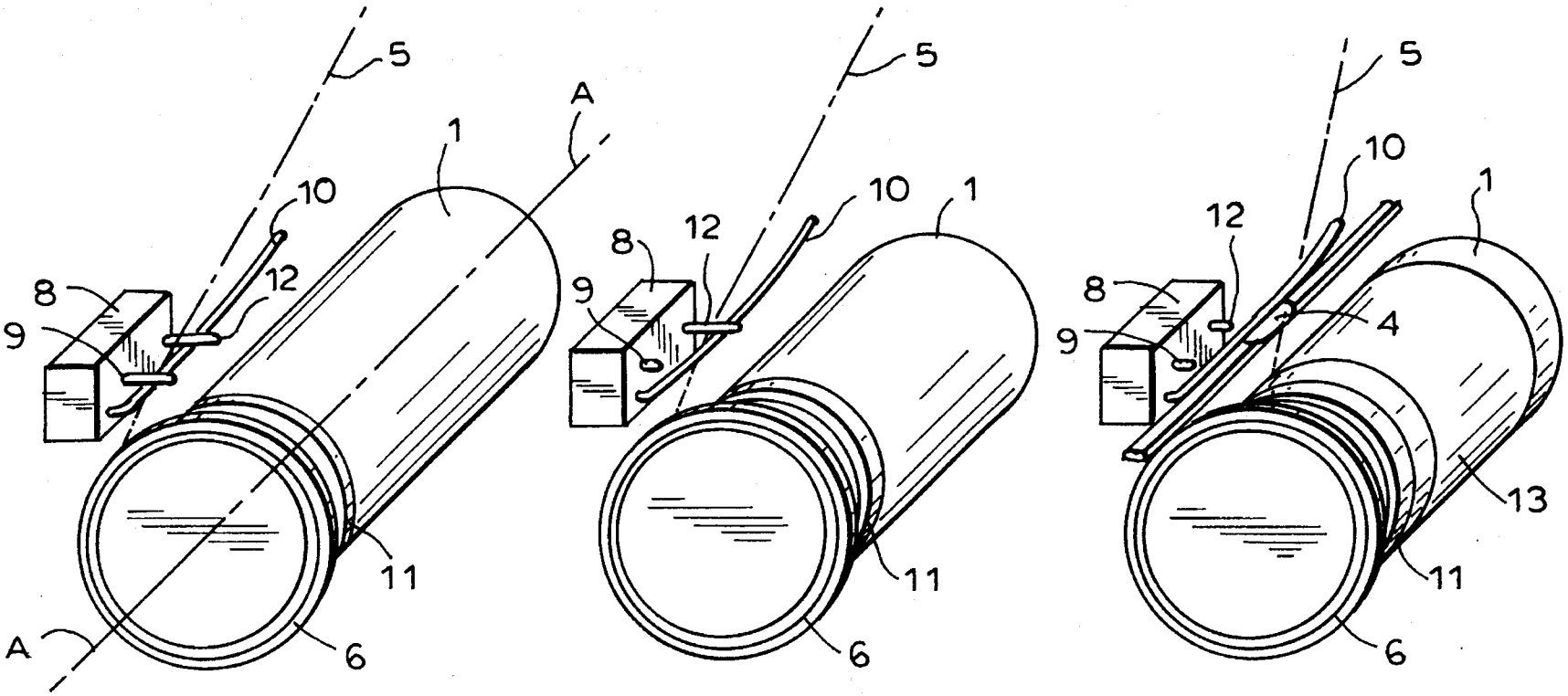
FIGS. 2A, 2B, and 2C are small-scale diagrammatic views illustrating succeeding steps of the method of this invention.
Figure 4A:
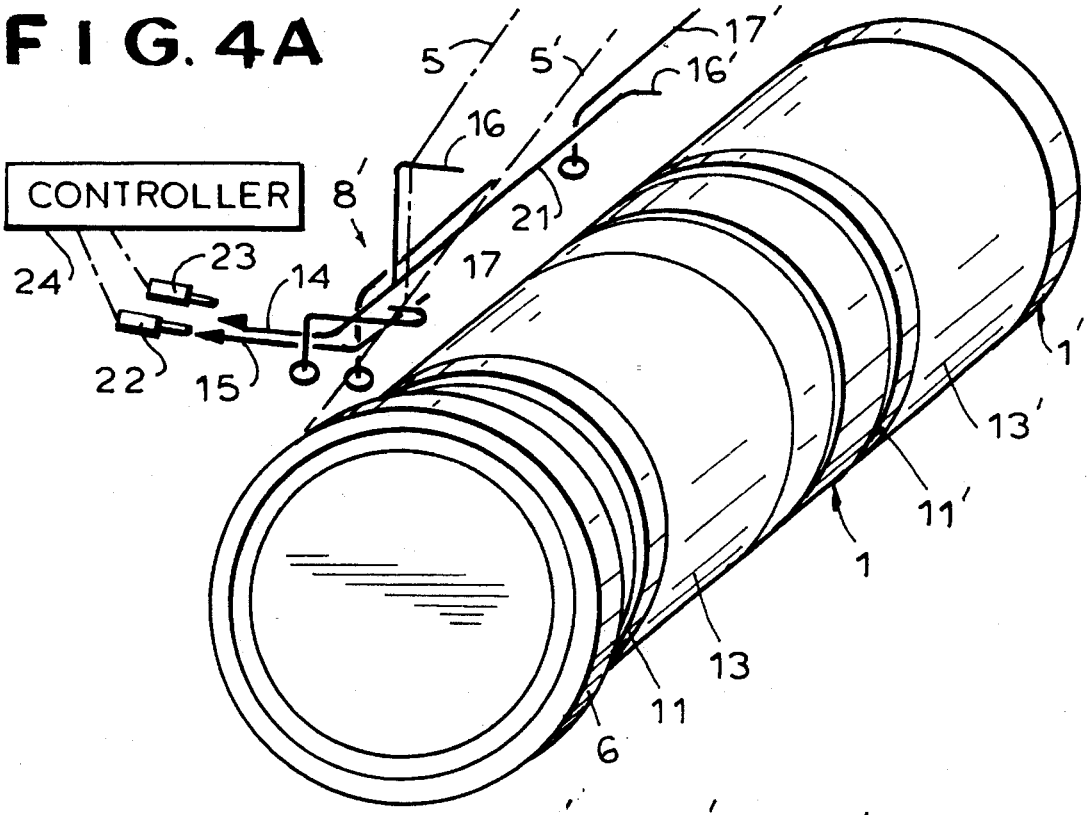
FIGS. 4A, 4B, and 4C are small-scale diagrammatic views illustrating succeeding steps of the method of this invention with the FIG. 3 system.

The system of FIGS. 3, 4A–4C, and 5A–5C is generally identical to that described above and identical reference numerals are used for functionally and/or structurally identical elements. Here, however, two filaments 5 and 5' are simultaneously wound on two respective cores or spools 1 and 1' carried coaxially on the support 2 and having respective short and long regions 11, 11' and 13, 13'. The guide 8' here comprises a hook 14 adjacent the single ring 6, a blocking wire 15 movable to close and open this hook 14, outer and inner stop wires 16 and 16' carried on a common support wire 21, and stationary back guide wires 17 and 17'. Respective actuators 22 and 23 can laterally displace the elements 15, 21, and 17 under the command of a common controller 24 (FIG. 4A).

Figures 5A, 5B, 5C:
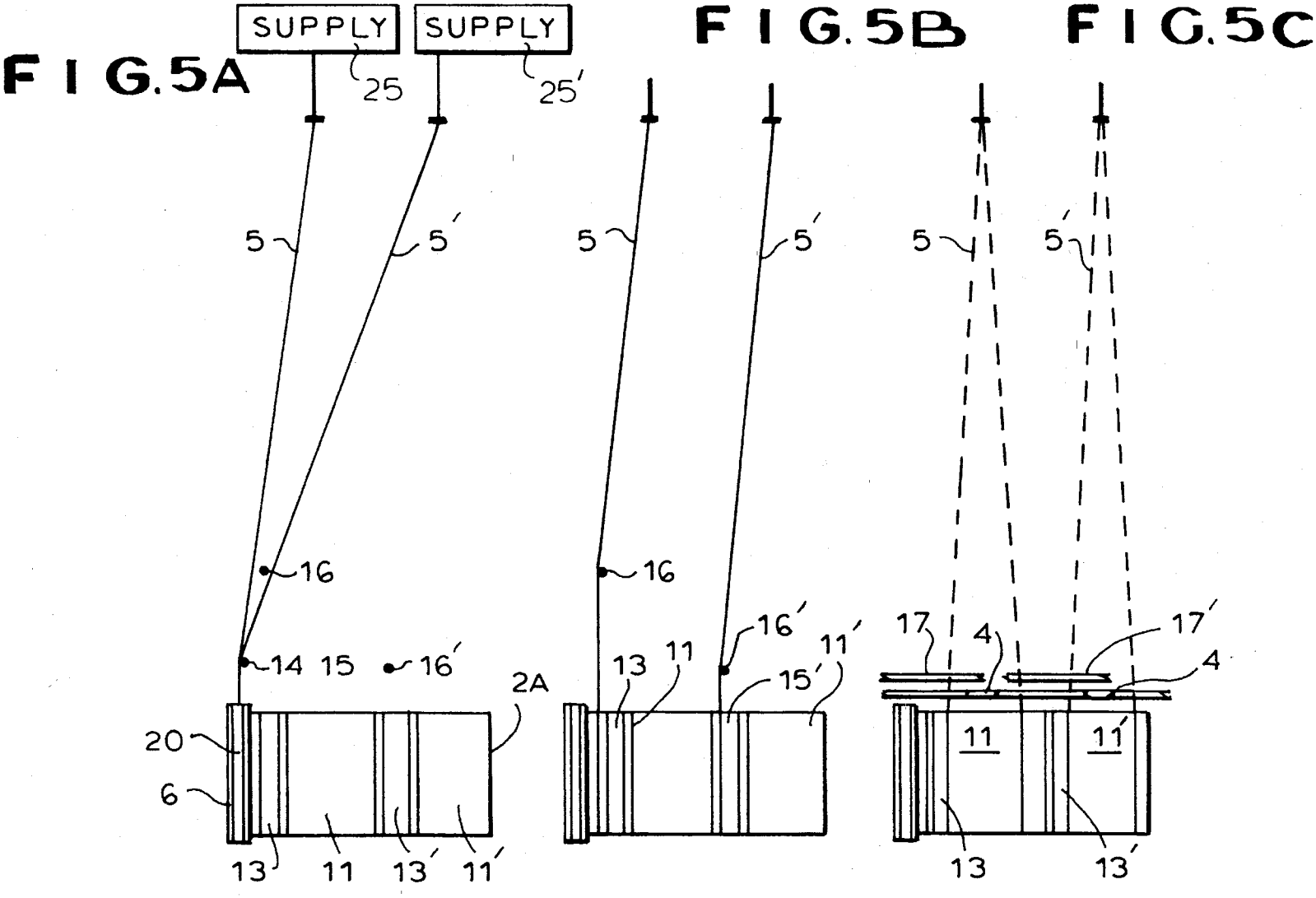
FIG. 5A, 5B, and 5C are smaller-scale top views corresponding to FIGS. 4A, 4B, and 4C, respectively.

To start as seen in solid lines in FIG. 3 and in FIGS. 4A and 5A the two filaments 5 and 5' are captured in the hook 14 by the stop guide 15 and are both wound up on the ring 6. This gets these yarns 5 and 5' up to speed, taking any looseness out of them upstream to the respective supplies 25 and 25' (FIG. 5A).

Figure 4B:
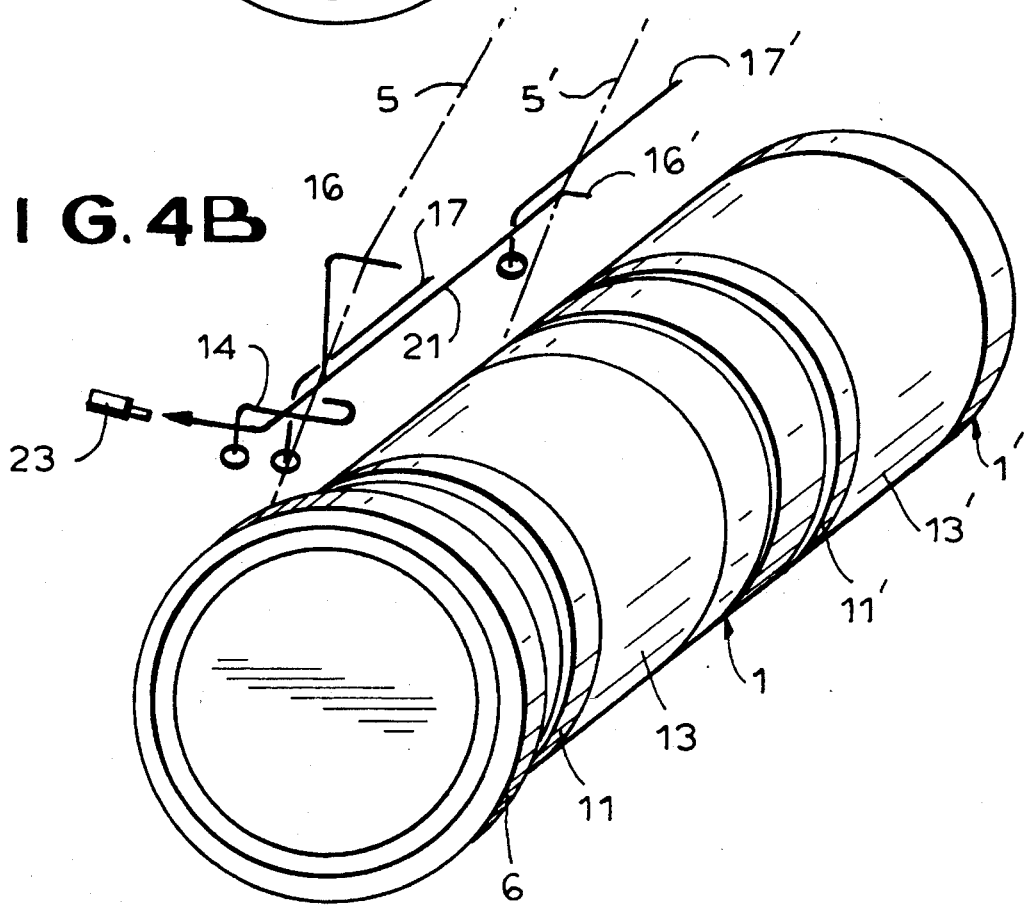

Then as seen in FIGS. 4B and 5B the controller 24 operates the actuator 22 to pull back the retaining guide 15, allowing the filaments 5 and 5' to slide back along the wires 17 and 17' and catch, respectively, on the back guides 16 and 16' that are level with the respective transfer regions 11 and 11'. Continued rotation of the sleeves 1 and 1' thus winds up several turns of the filaments 5 and 5' on these respective regions 11 and 11'.

Figure 4C:
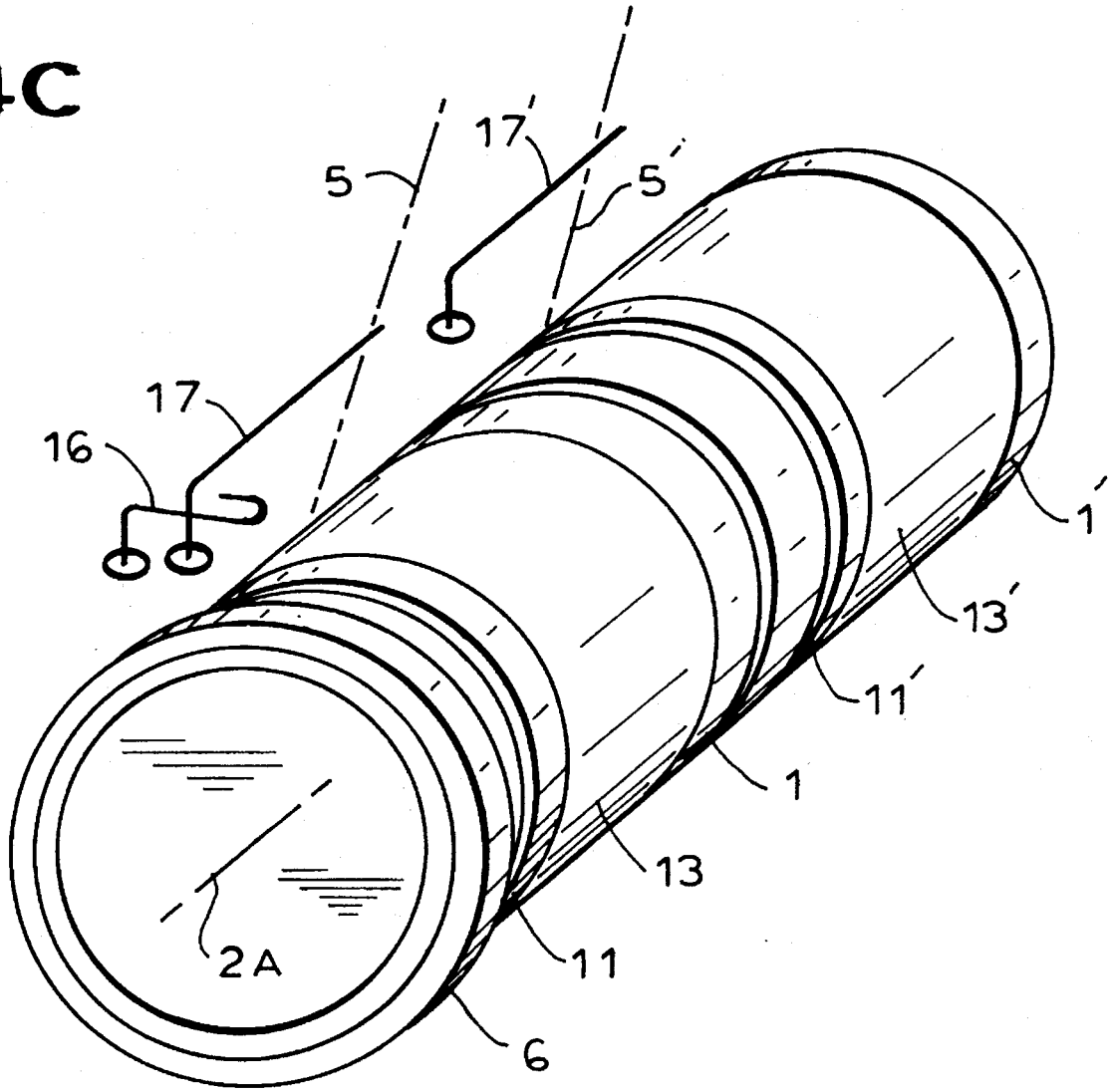

Finally as seen in FIGS. 4C and 5C the controller 24 operates the actuator 23 to pull back the guides 16 and 16' so that the filaments 5 and 5' slide back along the wires 17 and 17' to catch in respective traverses 4 and 4' which, as known per se, lay the filaments in neat layers on the respective main regions 11 and 11'.

I claim:

1. An apparatus for winding a synthetic-resin yarn on a spool of predetermined outside diameter, the apparatus comprising:

a friction drive roller rotatable about a drive axis and having a substantially cylindrical outer surface of predetermined length centered on the drive axis;

means for continuously rotating the drive roller about the drive axis at a substantially constant speed;

a support adjacent the friction roller holding the spool for rotation about a spool axis generally parallel to the drive axis and with the spool in radial contact with the surface of the drive roller;

a radially outwardly projecting ridge carried on the support axially offset from the surface of the friction roller and of greater outside diameter than the spool; and guide means for feeding the yarn initially to the ridge for winding of the yarn thereon and for thereafter for feeding the yarn to the spool for winding of the yarn on the spool.

2. The yarn-winding apparatus defined in claim 1 wherein the diameter of the ridge is between 1% and 10% larger than the diameter of the spool.

3. The yarn-winding apparatus defined in claim 1 wherein the ridge is mounted on the spool.

4. The yarn-winding apparatus defined in claim 1 wherein the ridge is part of the support.

5. The yarn-winding apparatus defined in claim 1 wherein the ridge is provided with a yarn-retaining formation.

6. The yarn-winding apparatus defined in claim 1 wherein the guide means includes a movable guide aligned generally radially of the spool axis with the ridge.

7. The yarn-winding apparatus defined in claim 1 wherein the spool is subdivided into a long main region adapted to receive a relatively large yarn body and a short end region offset axially from the main region and adapted to receive transfer loops of the yarn, the guide means feeding the yarn to the short end region to wind several such transfer loops of the yarn on the end region after winding it on the ridge and before winding it on the main region.

8. The yarn-winding apparatus defined in claim 1 wherein the guide means includes an outer movable guide generally aligned radially of the spool axis with the ridge and an inner movable guide generally aligned radially of the spool axis with the short end region.

9. The yarn-winding apparatus defined in claim 1 wherein the guide means includes a traverse and means for axially reciprocating the traverse adjacent the spool outer surface.

10. The yarn-winding apparatus defined in claim 1 wherein the guide means includes a hook axially fixed relative to the axes adjacent the ridge and a movable element for trapping the yarn in the hook during winding on the ridge.

11. A method of winding a yarn on a spool having a generally cylindrical outer surface centered on a spool axis, the method comprising the steps of:

supporting the spool for rotation about the spool axis;

supporting for rotation about a drive axis generally parallel to the spool axis a friction drive roller with a substantially cylindrical outer surface of a predetermined length centered on the drive axis;

supporting for rotation about the spool axis a radially outwardly projecting ridge axially offset from the roller surface and of greater outside diameter than the spool outer surface;

catching the yarn on the ridge;

thereafter engaging the rotating friction roller radially with the spool and rotating the roller to rotate the spool about the spool axis at a peripheral speed equal to a peripheral speed of the surface of the friction roller, whereby an outer surface of the ridge moves at a peripheral speed greater than that of the spool outer surface;

initially feeding the yarn to the ridge and thereby initially winding the yarn on the ridge; and thereafter feeding the yarn to the spool to wind the yarn thereon and form a yarn package on the spool.

12. The yarn-winding method defined in claim 11 wherein two such spools are supported for rotation about the spool axis and are radially engaged by the friction roller for joint coaxial rotation, two such yarns being caught on the ridge and initially wound thereon, the yarns thereafter being fed to respective ones of the spools for forming respective yarn bodies thereon.

13. The yarn-winding method defined in claim 11 wherein the spool surface is subdivided into a relatively short end transfer region and a relatively long main region and the spool is formed between the regions with a radially outwardly open groove, the yarn package being formed on the long main region, the method further comprising the step of guiding the yarn to the short end region after winding the yarn on the ridge and before winding the yarn on the main region to wind a plurality of turns of the yarn on the short end region.

14. The yarn-winding method defined in claim 11 wherein the yarn is guided to the ridge by being passed over a movable stop that is displaced out of engagement with the yarn for feeding of the yarn to the spool for forming the package thereon.

15. The yarn-winding method defined in claim 11 wherein during winding of the yarn on the spool surface the yarn is passed over a traverse axially reciprocated adjacent the spool.

* * * * *